US011446835B2

(12) United States Patent
Peterson et al.

(10) Patent No.: US 11,446,835 B2
(45) Date of Patent: Sep. 20, 2022

(54) SHAVING RAZOR CARTRIDGE

(71) Applicant: The Gillette Company LLC, Boston, MA (US)

(72) Inventors: Mark Peterson, Reading (GB); Nuala Desai, Reading (GB); Daniel Edward Dunham, Wiltshire (GB); Neil Dustin Lettenberger, Boston, MA (US); Jack Anthony Washington, Mendon, MA (US)

(73) Assignee: The Gillette Company LLC, Boston, MA (US)

( * ) Notice: Subject to any disclaimer, the term of this patent is extended or adjusted under 35 U.S.C. 154(b) by 84 days.

(21) Appl. No.: 16/863,251

(22) Filed: Apr. 30, 2020

(65) Prior Publication Data

US 2021/0016458 A1 Jan. 21, 2021

Related U.S. Application Data

(60) Provisional application No. 62/874,231, filed on Jul. 15, 2019.

(51) Int. Cl.
*B26B 21/22* (2006.01)
*B26B 21/40* (2006.01)

(52) U.S. Cl.
CPC ..... *B26B 21/227* (2013.01); *B26B 21/4012* (2013.01)

(58) Field of Classification Search
None
See application file for complete search history.

(56) References Cited

U.S. PATENT DOCUMENTS

| | | | | |
|---|---|---|---|---|
| 5,475,923 | A | 12/1995 | Ferraro | |
| 5,689,883 | A | 11/1997 | Ortiz | |
| 5,953,819 | A | 9/1999 | Simms | |
| 6,941,659 | B2 * | 9/2005 | Gilder | B26B 21/4018 30/34.2 |
| 6,948,249 | B2 * | 9/2005 | Barone | B26B 21/222 30/41 |
| D563,043 | S | 2/2008 | Ramm | |
| D604,904 | S | 11/2009 | Watson | |
| D627,100 | S | 11/2010 | Kinard | |
| D627,101 | S | 11/2010 | Kinard | |
| D634,474 | S | 3/2011 | Wilby | |

(Continued)

FOREIGN PATENT DOCUMENTS

| | | |
|---|---|---|
| RU | 2181324 C2 | 4/2002 |
| RU | 2564649 C1 | 10/2015 |

OTHER PUBLICATIONS

International Search Report and Written Opinion; Application No. US2020/042063 dated Oct. 14, 2020; 10 pages.

(Continued)

*Primary Examiner* — Hwei-Siu C Payer
(74) *Attorney, Agent, or Firm* — John M. Lipchitz

(57) ABSTRACT

A shaving razor cartridge with a housing having a front portion with a front face and an upper skin contacting surface. At least one blade is mounted to the housing. The blade has a cutting edge extending toward the front portion. The upper skin contacting surface defines a bifurcated channel having an opening at a first end toward the front face and a pair of openings at an opposing end to facilitate the flow of fluid.

13 Claims, 3 Drawing Sheets

(56) References Cited

U.S. PATENT DOCUMENTS

| | | | | |
|---|---|---|---|---|
| D662,661 | S | 6/2012 | Corbeil | |
| 8,209,869 | B2 | 7/2012 | Royle | |
| 8,413,334 | B2 | 4/2013 | Walker, Jr. | |
| 8,438,736 | B2 | 5/2013 | Keene | |
| D699,892 | S | 2/2014 | Wonderley | |
| D701,646 | S | 3/2014 | Jobdevairakkam | |
| 8,661,689 | B2 * | 3/2014 | Fathallah | B26B 21/4012 30/34.2 |
| D707,885 | S | 6/2014 | Cataudella | |
| 8,931,176 | B2 | 1/2015 | Johnson | |
| D748,856 | S | 2/2016 | Mahony et al. | |
| D749,265 | S | 2/2016 | Cataudella | |
| 9,296,117 | B2 | 3/2016 | Fathallah | |
| D764,101 | S | 8/2016 | Cataudella | |
| D811,658 | S | 2/2018 | Cataudella et al. | |
| D843,059 | S | 3/2019 | Lettenberger | |
| D844,898 | S | 4/2019 | Knapp et al. | |
| D850,722 | S | 6/2019 | Knapp | |
| D866,858 | S | 11/2019 | Long et al. | |
| D872,937 | S | 1/2020 | Kottidi et al. | |
| D882,873 | S | 4/2020 | Goeder et al. | |
| D883,570 | S | 5/2020 | Liberatore | |
| D884,969 | S | 5/2020 | Zucker | |
| D884,970 | S | 5/2020 | Zucker | |
| D884,971 | S | 5/2020 | Zucker | |
| D892,406 | S | 8/2020 | Ren | |
| D895,208 | S | 9/2020 | Jin | |
| D897,040 | S | 9/2020 | Kong et al. | |
| D897,041 | S | 9/2020 | Ahn et al. | |
| D905,340 | S | 12/2020 | Fischer et al. | |
| D908,285 | S | 1/2021 | Cataudella et al. | |
| D912,324 | S | 3/2021 | Han et al. | |
| D912,325 | S | 3/2021 | Go et al. | |
| D913,591 | S | 3/2021 | Ramm et al. | |
| D933,295 | S * | 10/2021 | Washington | D28/47 |
| 2004/0025350 | A1 * | 2/2004 | Richard | B26B 21/227 30/50 |
| 2009/0223057 | A1 | 9/2009 | Coope-epstein | |
| 2014/0366381 | A1 | 12/2014 | Phipps et al. | |
| 2015/0013169 | A1 | 1/2015 | Warrick | |
| 2015/0040402 | A1 | 2/2015 | Carneiro et al. | |
| 2015/0090085 | A1 | 4/2015 | Griffin et al. | |
| 2016/0129603 | A1 | 5/2016 | Antoniou | |
| 2016/0158948 | A1 | 6/2016 | Eagleton | |
| 2016/0236364 | A1 | 8/2016 | Varenberg | |
| 2016/0279817 | A1 | 9/2016 | Washington et al. | |
| 2017/0021513 | A1 | 1/2017 | Liberatore | |
| 2017/0151684 | A1 | 6/2017 | Bozikis et al. | |
| 2017/0282388 | A1 | 10/2017 | Haines | |
| 2017/0282389 | A1 | 10/2017 | Jolley | |
| 2018/0071931 | A1 | 3/2018 | Walker, Jr. et al. | |
| 2018/0236677 | A1 | 8/2018 | Blatter | |
| 2021/0016458 | A1 * | 1/2021 | Peterson | B26B 21/4018 |
| 2021/0170614 | A1 * | 6/2021 | Han | B26B 21/4012 |
| 2021/0362362 | A1 * | 11/2021 | Lettenberger | B26B 21/4025 |

OTHER PUBLICATIONS

U.S. Appl. No. 29/698,168, filed Jul. 15, 2019, Jack Anthony Washington et al.

All Office Actions; U.S. Appl. No. 29/698,168 dated Apr. 15, 2021 and Aug. 13, 2021.

All Office Actions; U.S. Appl. No. 29/698,168.

U.S. Appl. No. 29/807,846, filed Sep. 15, 2021, Jack Anthony Washington et al.

* cited by examiner

SHAVING RAZOR CARTRIDGE

FIELD OF THE INVENTION

The present invention relates to shaving razors, and more particularly, to shaving razor cartridges having a housing with a skin contacting element for facilitating stretching of skin in localized areas and/or facilitating the passage of fluid to a blade for efficient and effective shaving.

BACKGROUND OF THE INVENTION

Razor cartridges are typically provided with a guard in front of the blades and a cap behind the blades which contact the skin before and after the blades respectively. The guard and cap may aid to establish the "shaving geometry" i.e. the parameters which determine blade orientation and position relative to the skin and have a strong influence on shaving performance and efficiency of the razor.

The guard is present on the razor cartridge to manage the skin and stretch the skin prior to contact with the blade to ensure optimal contact with the blade without negative skin sensations. The guards are typically provided from an elastomeric or thermoplastic material to further improve skin contact and tactile performance. Recently guards having longitudinal fins formed from such elastomeric materials have been incorporated on the cartridge in order to improve the orientation of the hair in order to maximize cutting efficiency, as described for example in WO 2010/039479 and U.S. 2012/0144675.

In order to provide lubrication to the skin during the shave, a shaving preparation is typically applied to the skin prior to shaving. In addition, the razor cartridge may also be provided with a shaving aid usually present on the cap and/or guard. The shaving aid contains a lubricant typically within a matrix structure, which is designed to release lubricant with water gradually during each shaving occasion and deposit onto the skin. The lubricant is beneficial in reducing the friction between the skin and the blades. However, it has been found that the optimization of the guard performance for skin stretch may impact the performance of the lubricating material from the shaving aid or preparation in that the guard reduces the ability of the lubricating material to contact the skin at the contacting points of the blade and skin.

There is thus a need to provide a razor cartridge which has a guard to provide the desired skin stretch and orientation prior to contact with the blade while ensuring sufficient contact of the fluid, shaving aid or lubricant with the skin to improve shave comfort and reduce skin irritation.

SUMMARY OF THE INVENTION

In one aspect, the invention features, in general a shaving razor cartridge with a housing having a front portion with a front face and an upper skin contacting surface. At least one blade is mounted to the housing. The blade has a cutting edge extending toward the front portion. The upper skin contacting surface defines a bifurcated channel having an opening at a first end toward the front face and a pair of openings at an opposing end to facilitate the flow of fluid.

In another aspect, the invention features, in general a shaving razor cartridge with a housing having a front portion with a front face and an upper skin contacting surface. At least one blade is mounted to the housing. The blade has a cutting edge extending toward the front portion. The upper skin contacting surface defines a plurality of bifurcated channels each having a first channel and a pair of sub channels extending toward the blade having a minimum width of 0.4 mm.

In another aspect, the invention features, in general a shaving razor cartridge with shaving razor cartridge with a housing having a front portion with a front face and an upper skin contacting surface. At least one blade is mounted to the housing. The blade has a cutting edge extending toward the front portion. The upper skin contacting surface defines a bifurcated channel having a first channel extending from a thru opening to the front face and a pair of sub channels extending from the opening toward the at least one blade.

DETAILED DESCRIPTION OF THE INVENTION

Figure 1:
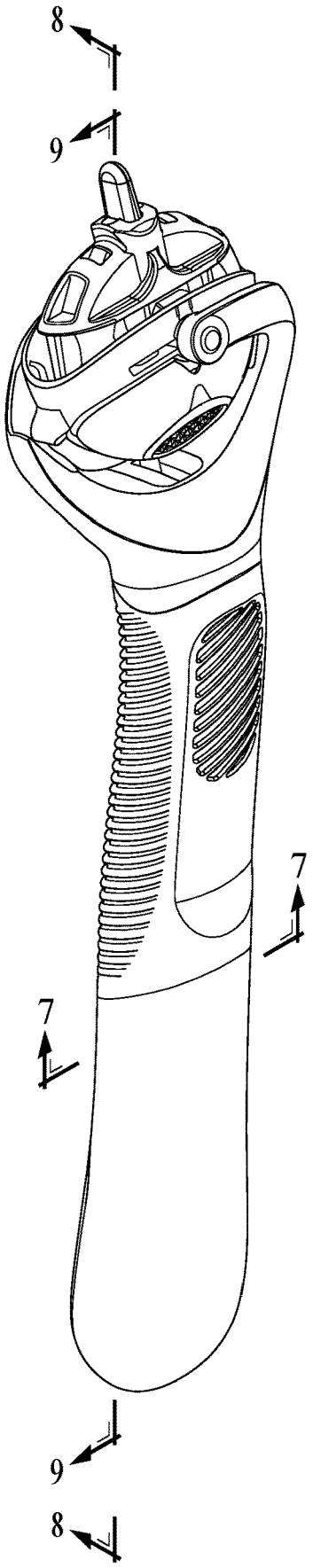
FIG. 1 is a top view perspective of one possible embodiment of a shaving razor cartridge of the present invention.

Referring to FIG. 1, a top view of a shaving razor cartridge 10 is illustrated. The shaving razor cartridge 10 may be mounted to a handle (not shown). The shaving razor cartridge 10 may be removable or permanently mounted to the handle. For example, the shaving razor cartridge 10 may be mounted detachably on a handle to enable the shaving razor cartridge 10 to be replaced by a fresh shaving razor cartridge 10 when the blade sharpness has diminished to an unsatisfactory level, or it may be attached permanently to the handle with the intention that the entire razor be discarded when the blade or blades have become dulled. The shaving razor cartridge may include a housing 12. The housing 12 may be molded out of a rigid plastic or manufactured from other materials, such as metal. In certain embodiments, the housing 12 may comprise Noryl™ (a blend of polyphenylene oxide (PPO) and polystyrene developed by General Electric Plastics, now SABIC Innovative Plastics). The housing 12 may be molded from other semi-rigid polymers having a Shore A hardness of about 50, 60 or 70 to about 90, 110, or 120.

The housing may have a rear portion 14 with a cap 16 and a front portion 18 with an upper skin contacting surface 20. In certain embodiments, the cap 16 may include a lubricant. One or more blades 22 may be mounted to the housing between the cap 16 and the upper skin contacting surface 20. Each of the blades 22 may have a corresponding cutting edge 26 facing the front portion 18 of the housing 12. Although five blades 22 are shown, the shaving razor cartridge 10 may have more or fewer blades 22 depending on the desired performance and cost of the shaving razor cartridge 10. The blades 22 may be secured to the housing with a clip 24. However, other assembly methods known to those skilled in the art may also be used to secure and/or mount the blades 22 to the housing 12 including, but not limited to, wire wrapping, cold forming, hot staking, insert molding, ultrasonic welding, welding and adhesives.

The front portion 18 of the housing may include a front face 28. The front portion 18 may define one or more bifurcated channels 30. In certain embodiments, the bifurcated channel 30 may extend into the front face 28 to facilitate the transfer of water, shaving cream or other lubricants towards the blades 22 for an improved shave. The shaving razor cartridge 10 may have a plurality of bifurcated channels 30 extending along the front portion 18 of the housing 12. For example, FIG. 1 illustrates six bifurcated channels 30. However, it is understood more or less bifurcated channels 30 may be used depending on the size of the shaving razor cartridge 10. The bifurcated channel 30 may have an opening 32 at a first end toward the front face 28 and a pair of openings 34 and 36 at an opposing end toward the blade 22 to facilitate the unobstructed flow of shaving aids and water. The pair of openings 34 and 36 may extend to an open slot 38 in front of a guard 40 that supports the skin to aid in establishing the shaving geometry of the shaving razor cartridge 10. The guard 40 may be segmented to facilitate the flow of fluid from the bifurcated channel 30 to the blades 22. Each bifurcated channel 30 may have a span "S1" of about 3 mm to about 6 mm (i.e., in a lateral direction) and extend a front to rear direction a distance "d1" of about 2 mm to about 5 mm. The span may be the horizontal distance from a lateral end of the opening 34 to a lateral end of the opening 36.

Figure 2:
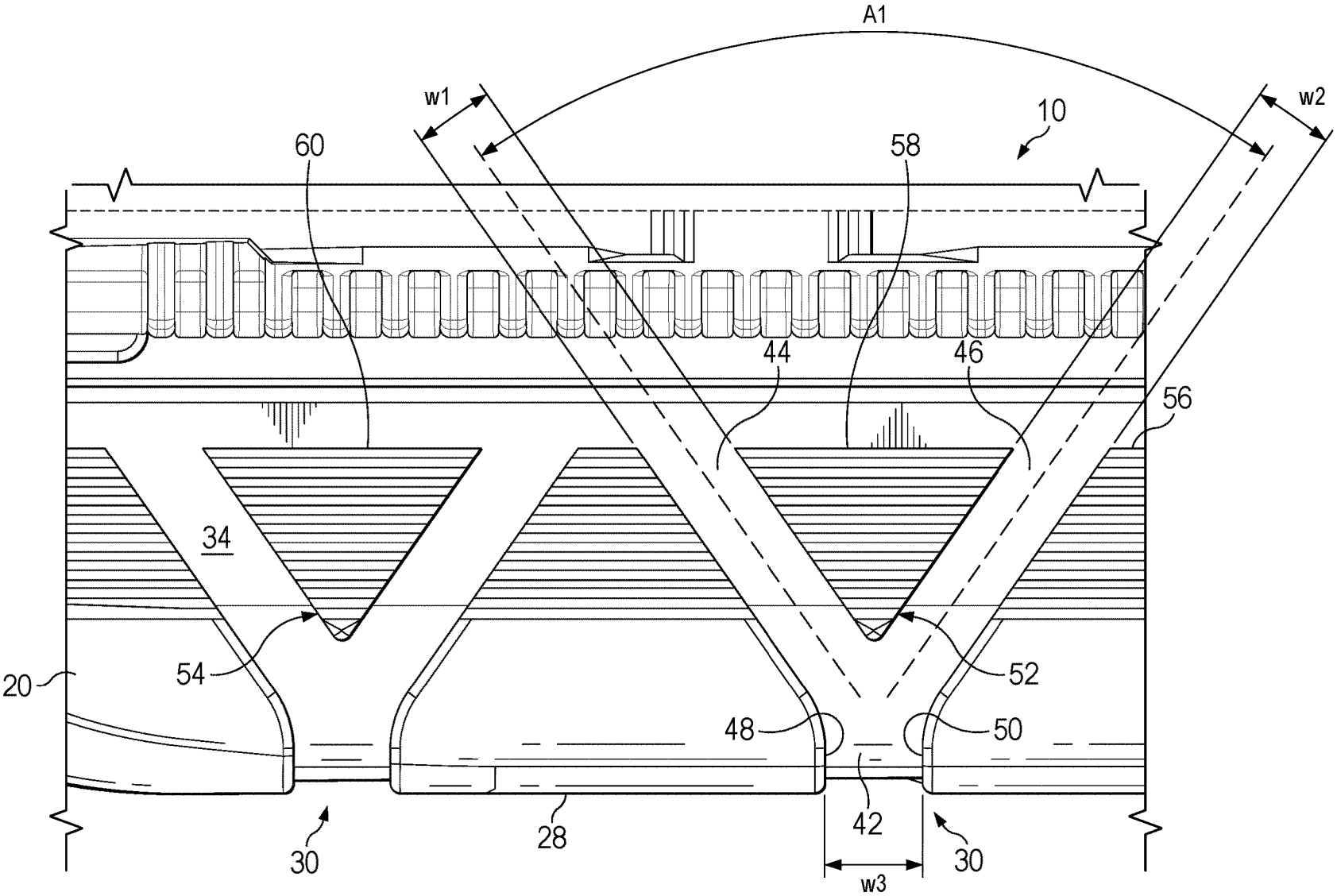
FIG. 2 is an enlarged view of a portion of the shaving razor cartridge of FIG. 1.

Referring to FIG. 2, an enlarged view of a portion of the shaving razor cartridge 10 of FIG. 1 is illustrated. In certain embodiments, the bifurcated channels 30 may include a first channel 42 extending into the front face 28 and a pair of sub channels 44 and 46 extending from the first channel 42 toward the blade 22 (FIG. 1). The sub channels 44 and 46 may have a respective width "W1" and "W2" that is greater than or equal to 0.4 mm, for example, about 0.4 mm to about 1.5 mm. The sub channels 44 and 46 may diverge, as shown in FIG. 2, thus diverting fluid along two paths at an angle A1 relative to each other. In certain embodiments, the angle A1 may be about 10 degrees to about 60 degrees. It is believed without being held to theory, the sub channels 44 and 46 help keep excess fluid off the upper skin contacting surface 20 to improve skin stretching. Furthermore, diverting fluid from one path to two paths may improve fluid transfer, which may help spread and move excess fluid towards the blades 22 and away from the skin contacting surface 20. The first channel 42 may be defined by a pair of lateral walls 48 and 50. In certain embodiments, the first channel 42 may have a width "W3" (between the lateral walls 48 and 50) that is greater than the width W1 and W2 of the sub-channels 44 and 46. For example, "W3" may have a width of about 1 mm to about 5 mm. In other embodiments, the widths W1, W2, and W3 may be generally equivalent. As will be described in further detail below, creating two diverging fluid paths may allow both skin stretching and fluid transfer to occur simultaneously across the front portion 18 of the shaving razor cartridge 10.

A portion 52 of the upper skin contacting surface 20 may be positioned between each of the sub-channels 44 and 46. The portions may have a triangular shape that defines the angle A1 of the sub-channels 44 and 46. Additional portions 54 and 56 of the upper skin contacting surface 20 may also be positioned between adjacent bifurcated channels 30. In certain embodiments, the portions 52, 54 and 56 of the upper skin contacting surface 20 positioned between adjacent bifurcated channels 30 may include a plurality of protrusions (e.g., fins) 58. Accordingly, the shaving razor cartridge 10 may facilitate both fluid management and skin stretching in a front to rear direction along a length of the front portion 18 of the housing 12. The bifurcated channels 30 may have a height of about 0.25 mm to about 2.0 mm to help capture and carry fluid. The height may be measured from a bottom surface 35 of the bifurcated channel 30 (e.g., the sub channels 44 and 46 or the first channel 42) to highest point 60 of the upper skin contacting surface 20 that bounds the bifurcated channel 30 (e.g., top of fins 58).

In certain embodiments, the upper skin contacting surface 20 may be insert injection molded or co-injection molded to the housing 12, however, other known assembly methods may also be used such as adhesives, ultrasonic welding, or mechanical fasteners. The upper skin contacting surface 20 may be part of the housing 12 and may comprise the same material as the housing 12. In other embodiments, the upper skin contacting surface 20 may be molded from a softer material than the housing 12. For example, the upper skin contacting surface 20 may have a Shore A hardness of about 20, 30, or 40 to about 50, 60, or 70. The upper skin contacting surface 20 may be made from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, upper skin contacting surface 20 may comprise Kraiburg HTC 1028/96, HTC 8802/37, HTC 8802/34, or HTC 8802/11 (KRAIBURG TPE GmbH & Co. KG of Waldkraiburg, Germany). A softer material may enhance skin stretching, as well as provide a more pleasant tactile feel against the skin of the user during shaving.

Figure 3:
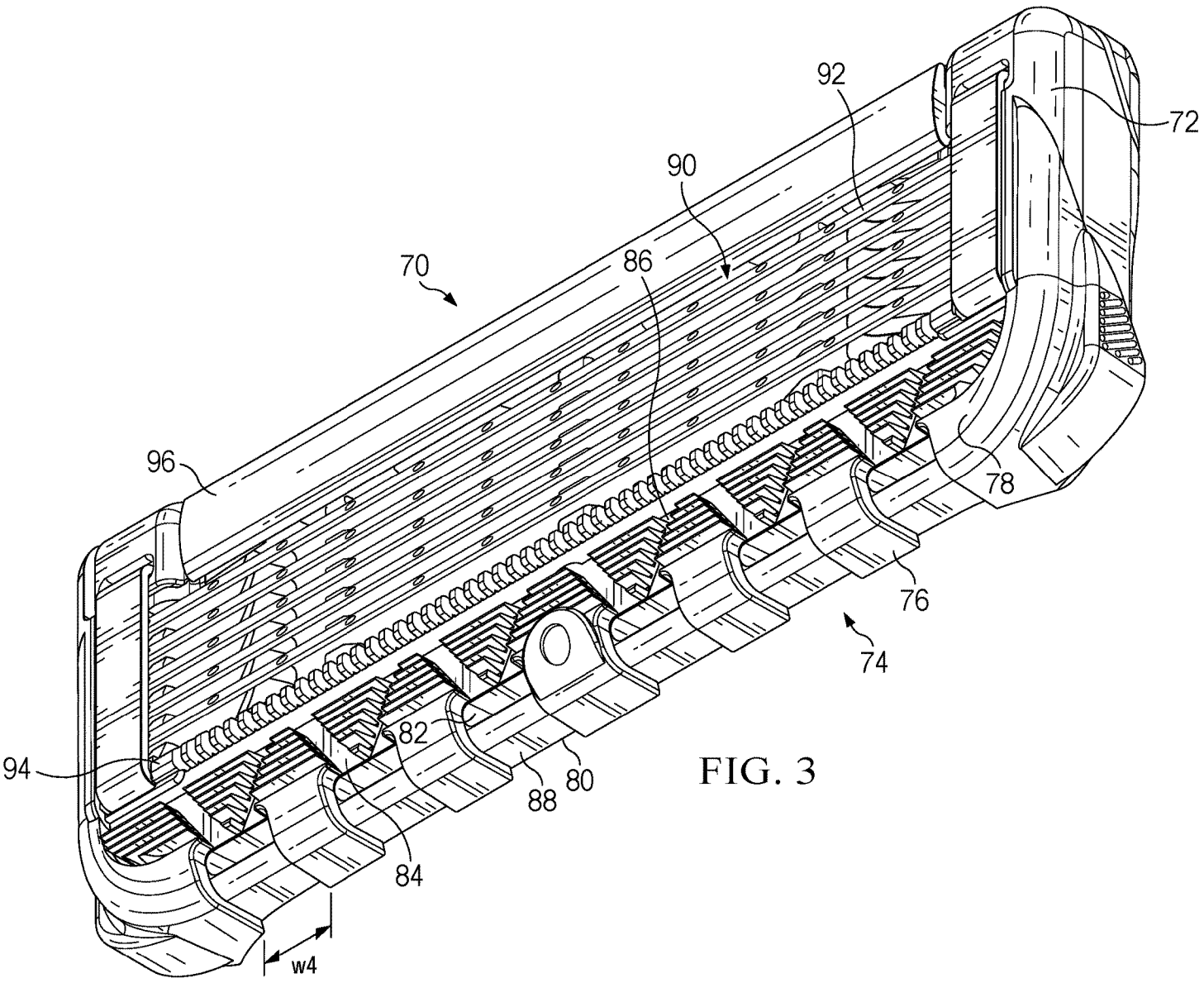
FIG. 3 is a top view of another possible embodiment of a shaving razor of the present invention.

Referring to FIG. 3, a top perspective view of an alternative embodiment of a shaving razor cartridge 70 is shown. The shaving razor cartridge 70 may be similar to the shaving razor cartridge 10 as previously described. For example, the shaving razor cartridge may include a housing 72 having a front portion 74 with a front face 76. The housing 72 may have an upper skin contacting surface 78 defines one or more bifurcated channels 80. However, the shaving razor cartridge 70 of FIG. 3 may have one or more thru openings 82 within one or more of the bifurcated channels 80 to aid in the distribution of fluid. The bifurcated channel may include a pair of sub channels 84 and 86 that are in communication with the thru opening 82. In certain embodiments, a first channel 88 may extend from the front face 76 to the opening 80. The opening may have a width "w4" of about 1 mm to about 5 mm. Fluid may enter the sub channels 84 and 86 via the front face 76 and the opening 82. Accordingly, the opening 82 may help channel more fluid. It is understood that the other feature of the shaving razor cartridge may be the same as the shaving razor cartridge 10 of FIG. 1. For example, the shaving razor cartridge 70 may have at least one blade 90 mounted to the housing 72. The blades 90 may each have a cutting edge 92 extending toward the front portion 74. The blades 90 may be positioned between a guard 94 and a cap 96. The dimensions of the sub channels 84 and 86, the first channel 88 and the bifurcated channels 80 may be the same as for the shaving razor cartridge 10, as previously described.

Although FIGS. 1-3 illustrate bifurcated channels having a first channel in front of a pair of sub channels, it is understood that the orientation of the bifurcated channel may be flipped so the sub channels are in front of the first channel. Accordingly, the sub channels may extend into the front face and extend in a rearward direction to the first channel.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". In an effort to avoid any ambiguity, for the purposes of this disclosure, the term "portion" shall be construed as meaning less than 50%. For example, the term "distal end portion" should be interpreted as from about 0%, 5%, 10%, or 15% to about 15%, 20%, 25%, 30%, 40% or 45% from the terminal end of the element referenced. Similarly, the term "proximal end portion" should be interpreted as from about 0%, 5%, 10%, or 15% to about 15%, 20%, 25%, 30%, 40% or 45% from the end opposite the terminal end of the element referenced.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing having a front portion with a front face and an upper skin contacting surface; at least one blade mounted to the housing, the blade having a cutting edge extending toward the front portion, wherein the upper skin contacting surface defines a bifurcated channel having a pair of sub channels extending from a first channel that extends into the front face, a first end of the bifurcated channel having an opening toward the front face and a pair of openings at an end of the bifurcated channel opposite the first end to facilitate the flow of fluid.

2. The shaving razor cartridge of claim 1 wherein the first channel has a width of at least 0.40 mm.

3. The shaving razor cartridge of claim 1 wherein the pair of sub channels each with a width in the range of 0.40 mm to 1.5 mm.

4. The shaving razor cartridge of claim 1 wherein a portion of the upper skin contacting surface between the sub channels has a plurality of fins.

5. The shaving razor cartridge of claim 4 wherein a length of the fins toward the front face is less than a length of the fins toward the blade.

6. The shaving razor cartridge of claim 4 wherein adjacent fins of the plurality of fins are spaced apart by a gap in communication with the sub channels.

7. The shaving razor cartridge of claim 1 wherein the bifurcated channel has a height in the range of 0.25 mm to 2.0 mm.

8. The shaving razor cartridge of claim 1 wherein a width of the first channel is greater than a width of at least one of the sub channels.

9. The shaving razor cartridge of claim 1 wherein the sub channels are diverging.

10. The shaving razor cartridge of claim 1 wherein the sub channels are in front of an open slot extending parallel to the blade.

11. The shaving razor cartridge of claim 10 wherein the sub channels are in fluid communication with the open slot.

12. The shaving razor cartridge of claim 1 wherein the front portion comprises an elastomeric material.

13. The shaving razor cartridge of claim 1 wherein a span of the bifurcated channel is in the range of 3 mm to 6 mm.

* * * * *